US009961723B2

(12) United States Patent
Chen

(10) Patent No.: US 9,961,723 B2
(45) Date of Patent: May 1, 2018

(54) HEATING PLATE FOR HEATED CLOTHING AND CONNECTING STRUCTURE OF THE SAME

(71) Applicant: MEC ADDHEAT CO., LTD., Tainan (TW)

(72) Inventor: Chien-Chou Chen, Tainan (TW)

(73) Assignee: MEC Addheat Co., Ltd., Tainan (TW)

( * ) Notice: Subject to any disclaimer, the term of this patent is extended or adjusted under 35 U.S.C. 154(b) by 327 days.

(21) Appl. No.: 14/795,952

(22) Filed: Jul. 10, 2015

(65) Prior Publication Data

US 2017/0013677 A1 Jan. 12, 2017

(51) Int. Cl.

| | |
|---|---|
| ***A41D 13/005*** | (2006.01) |
| ***H05B 3/34*** | (2006.01) |
| ***H05B 1/02*** | (2006.01) |
| ***H05B 3/06*** | (2006.01) |
| *H05B 3/28* | (2006.01) |
| *H05B 3/04* | (2006.01) |

(52) U.S. Cl.

CPC ..... *H05B 3/342* (2013.01); *A41D 13/0051* (2013.01); *H05B 1/0272* (2013.01); *H05B 3/06* (2013.01); *H05B 3/04* (2013.01); *H05B 3/286* (2013.01); *H05B 2203/016* (2013.01); *H05B 2203/036* (2013.01)

(58) Field of Classification Search

None

See application file for complete search history.

(56) References Cited

U.S. PATENT DOCUMENTS

| | | | | |
|---|---|---|---|---|
| 3,808,403 | A * | 4/1974 | Kanaya | B63C 11/28 219/212 |
| 4,250,397 | A * | 2/1981 | Gray | H05B 3/36 219/212 |
| 4,468,557 | A * | 8/1984 | Bylin | H05B 3/36 174/51 |
| 8,253,071 | B2 * | 8/2012 | Weiss | H05B 1/0238 219/202 |
| 2001/0025846 | A1 * | 10/2001 | Kochman | H02H 5/043 219/545 |
| 2003/0047548 | A1 * | 3/2003 | Horey | H05B 3/342 219/212 |
| 2008/0083721 | A1 * | 4/2008 | Kaiserman | A43B 3/0005 219/211 |
| 2008/0116189 | A1 * | 5/2008 | Fernandez | A41D 13/0051 219/211 |

(Continued)

*Primary Examiner* — Joseph M Pelham

(74) *Attorney, Agent, or Firm* — Rosenberg, Klein & Lee

(57) ABSTRACT

This invention is related to a heating plate for a heated clothing and a connecting structure of the same. The heating plate comprises a heater strip which two ends are connected with two electric wires respectively, and each electric wire comprises sequentially a first right angle, a horizontal segment, a second right angle, and a vertical segment. The vertical segments of the electric wires go out from a covering piece which covers the heater strip and the electric wires. Therefore, when the electric wires of the heating plate are pulled, the pull strength is dispersed at the right-angle bend to be decreased, avoiding the heater strip moving. Furthermore, when the heating plate is set on the heated clothing, according to different size of the heated clothing, the length of an assembly electric wire is relative to the distance between the heating plates.

7 Claims, 7 Drawing Sheets

(56) References Cited

U.S. PATENT DOCUMENTS

| | | | | |
|---|---|---|---|---|
| 2009/0057288 | A1* | 3/2009 | Chen | H05B 3/342 219/211 |
| 2011/0186558 | A1* | 8/2011 | Campbell | H05B 3/34 219/201 |
| 2013/0037531 | A1* | 2/2013 | Gray | H05B 1/0272 219/211 |
| 2013/0227757 | A1* | 9/2013 | Chen | A41D 13/0051 2/69 |
| 2013/0228562 | A1* | 9/2013 | Chen | H05B 3/34 219/211 |
| 2014/0166638 | A1* | 6/2014 | Irgens | H05B 3/34 219/528 |
| 2015/0136753 | A1* | 5/2015 | Cronn | H05B 3/00 219/211 |
| 2015/0208739 | A1* | 7/2015 | Taylor | A41D 13/0051 219/211 |
| 2015/0272236 | A1* | 10/2015 | Chen | H05B 3/342 219/211 |
| 2015/0312965 | A1* | 10/2015 | Chen | H05B 3/34 219/211 |
| 2015/0382402 | A1* | 12/2015 | Chen | A41D 13/0051 219/211 |
| 2016/0262210 | A1* | 9/2016 | Xie | F24H 1/0018 |
| 2017/0013889 | A1* | 1/2017 | Chen | A41D 13/0051 |

* cited by examiner

HEATING PLATE FOR HEATED CLOTHING AND CONNECTING STRUCTURE OF THE SAME

BACKGROUND OF THE INVENTION

Field of the Invention

The present invention relates a heating plate for a heated clothing and a connecting structure of the same. More particularly, the disclosure relates to a heating plate and a connecting structure of the same that can avoid the heater strip being pulled to move and increase the assembled convenience.

Description of Related Art

After the heated clothing is used for a period of time to become dirty, it is usually washed and spun by a washing machine directly and is dried by a dry machine. However, the heated clothing is damaged seriously in the forging washing process. When the heated clothing is washed and spun by the washing machine, it is pulled irregularly by a strong strength caused by stirring of the washing machine. After the electric wires of the heating plate in the heated clothing are pulled by the strong strength, the heater strip connected to the electric wires is moved together. Although some producer use hot-melt adhesive to fix the heater strip in the heating intermediate layer, the melting point of the hot-melt adhesive is too low, resulting that the hot-melt adhesive is melted by the thermal energy produce by the heater strip, losing its fixed effect. Therefore, some producers stitch the heater strip 61 and the electric wires 62 onto the heating plate 6 by stitching wires 63 to keep the heater strip 61 and the electric wires 62 on the heating plate 6. It prevents the heater strip 61 from being pulled out of the heating plate 6 when the heater strip 61 is pulled, shown as FIG. 7. However, the stitch process expends manpower and time very much, it is not cost-effective.

Furthermore, the existing heated clothing is provided for customers with different physique, so the different sizes of the heated clothing are manufactured. The heating device in the existing heated clothing comprises one heating plate set at each front part and the back part respectively, and the each heating plate is connected together by an electric wire. The electric wire is also connected to a temperature control switch and a battery plug. In order to fit the different size of the heated clothing, the length of the electric wire for connection of the heating plates and the temperature control switch is relative to the biggest size of the heated clothing. However, when the foregoing design is applied to a smaller size of the heated clothing, the assembly process of the heating device is inconvenience because of the extra length of the electric wire. The over-length electric wire is twisted in the lining of the heated clothing, resulting that the twisted electric wire is broken easily under strong agitation and pull when the heated clothing is washed in the washing machine, affecting the life time of the heated clothing.

SUMMARY OF THE INVENTION

Therefore, the object of the present invention is related to a heating plate for a heated clothing and a connecting structure of the same. More particularly, the disclosure relates to a heating plate and a connecting structure of the same that can avoid the heater strip being pulled to move and increase the assembled convenience.

For the above object, a heating plate comprises a heater strip which two ends are connected with two electric wires respectively, and each electric wire comprises sequentially a first right angle, a horizontal segment, a second right angle, and a vertical segment. The vertical segments of the electric wires go out from a covering piece which covers the heater strip and the electric wires. Therefore, when the electric wires of the heating plate are pulled, the pull strength is dispersed at the right angle bend to be decreased, avoiding the heater strip moving. Furthermore, when the heating plate is set on the heated clothing, according to different size of the heated clothing, the length of an assembly electric wire is relative to the distance between the heating plates. The assembled convenience is increased because of the properly length of the assembly electric wire, and it avoids the electric wires being broken because the length of the assembly electric wire is too long.

DETAILED DESCRIPTION OF THE PREFERRED EMBODIMENT

Figure 1:
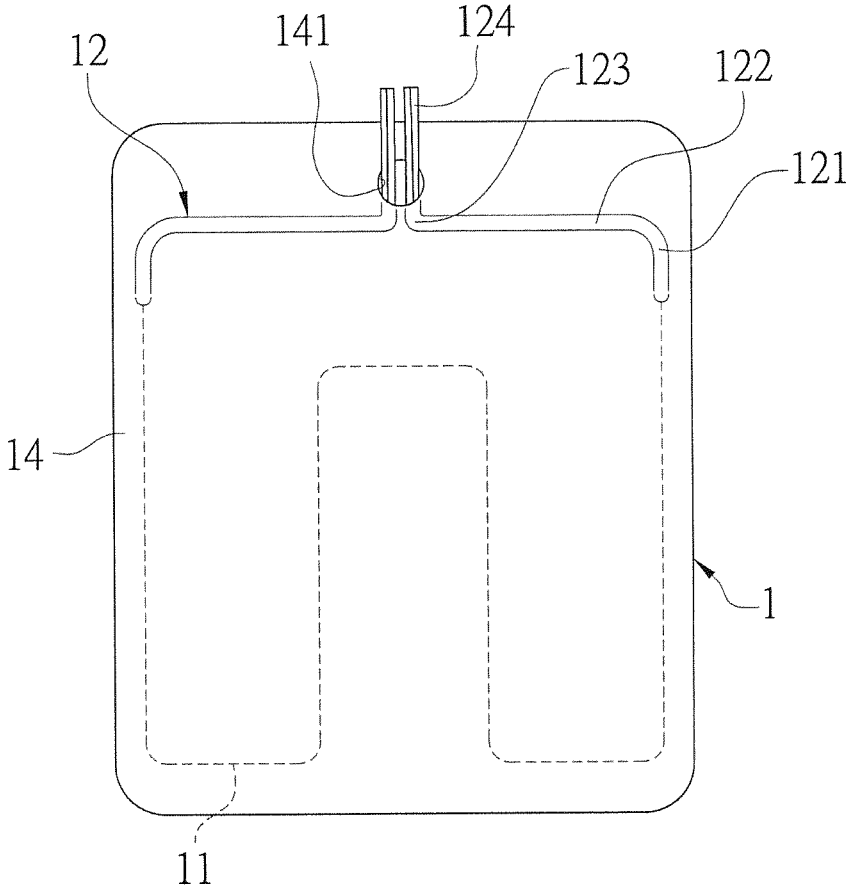
FIG. 1 is a front view of a heating plate according to an embodiment of the present invention.
Figure 2:
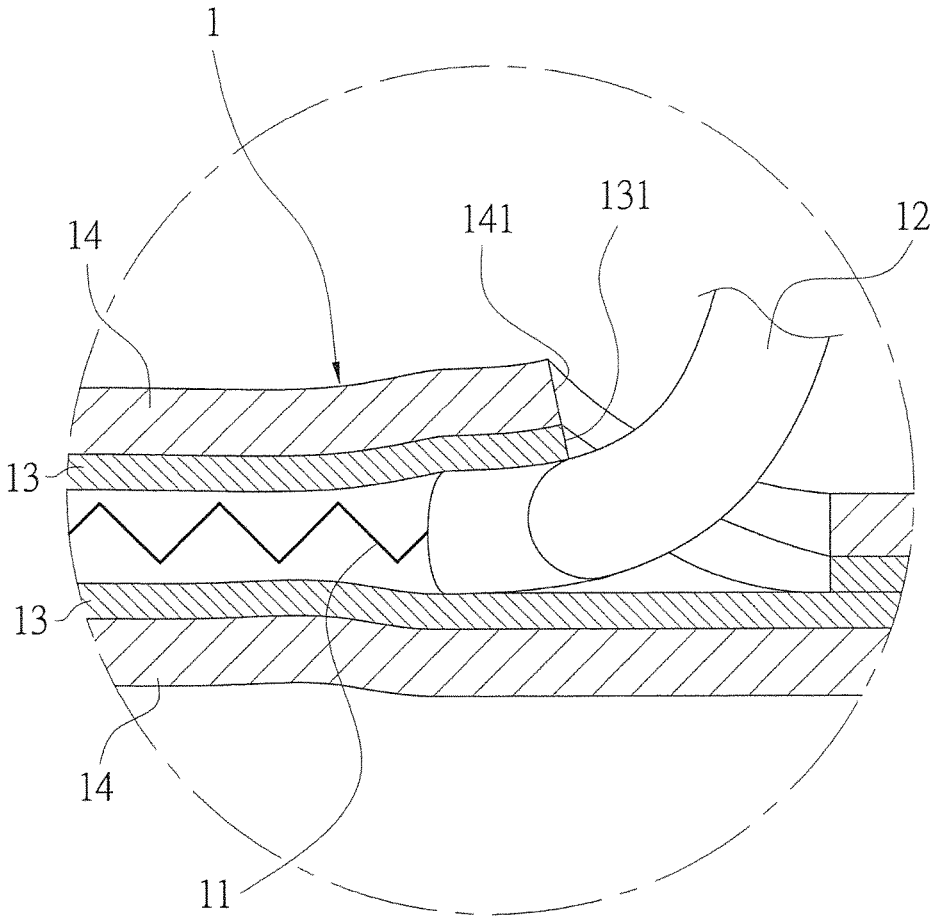
FIG. 2 is a partial cross-sectional view of a heating plate according to an embodiment of the present invention.

Please refer to FIG. 1 and FIG. 2. A heating plate 1 comprises a heater strip 11 and two electric wires 12 connected to the two ends of the heater strip 11 respectively. Each electric wire 12 comprises a first right angle 121, a horizontal segment 122 extended from the first right angle 121, a second right angle 123 bended from the other end of the horizontal segment 122, and a vertical segment 124 extended from the second right angle 123. The first right angles 121 of the two electric wires 12 are opposite to each other and the vertical segments 124 of the two electric wires 12 are converged at the central of the two electric wires 12. Two fixed layers 13 having a high melting point and formed as membrane are set at the two sides of the heater strip 11 and the electric wires 12. One of the fixed layers 13 is formed with an outlet 131 for the vertical segments 124 of the two electric wires 12 to go out, and the two fixed layers 13 are heat pressed so that the heater strip 11 and the electric wires 12 are held between the two fixed layers. Furthermore, two fabric covering pieces 14 are set at the outer surface of the two fixed layers 13 respectively, and one of the fabric covering pieces 14 is formed with an outlet 141 corresponding to the converged electric wires 12, so that the vertical segments 124 of the two electric wires 12 out from the fixed layer 13 are out from the outlet 141 of the covering piece 14. The periphery of the two covering pieces 14 is sealed together by sewing.

Figure 3:
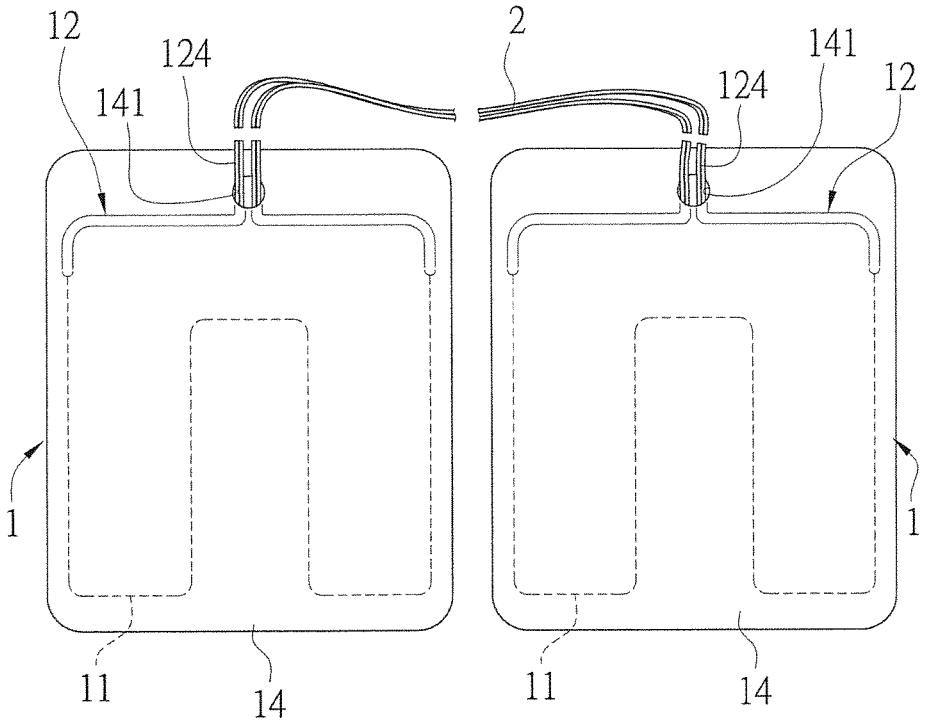
FIG. 3 is a front view of a connecting structure of heating plates in a heated clothing according to an embodiment of the present invention.

Please refer to FIG. 3. The vertical segments 124 of the two electric wires 12 of the heating plate 1 out from the covering piece 14 have fixed lengths, so that the heating plate 1 of the present invention is a fixed scale design. When the heating plates 1 of the present invention are assembled to a heated clothing, the length of an assembly electric wire 2 for connecting the heating plates 1 corresponds to the distance between the heating plates 1 according to different size of the heated clothing.

Figure 4:
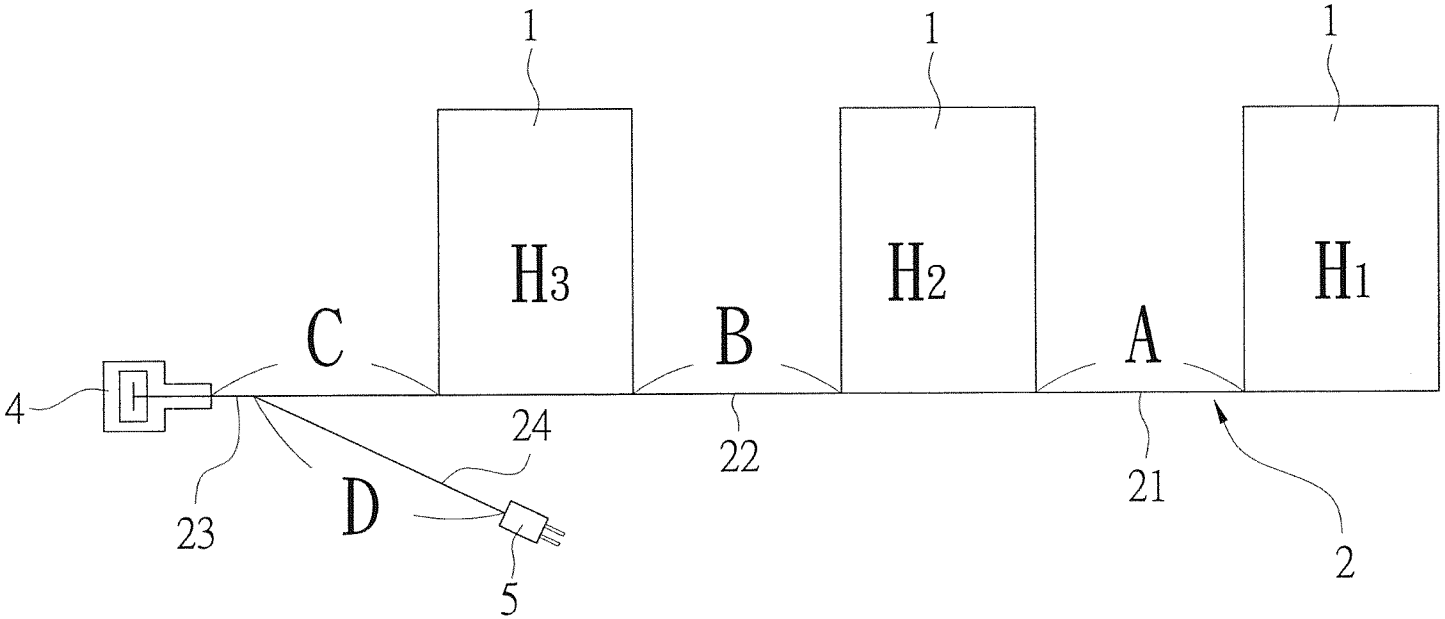
FIG. 4 is a diagram of a connecting structure of heating plates in a heated clothing according to another embodiment of the present invention.
Figure 5:
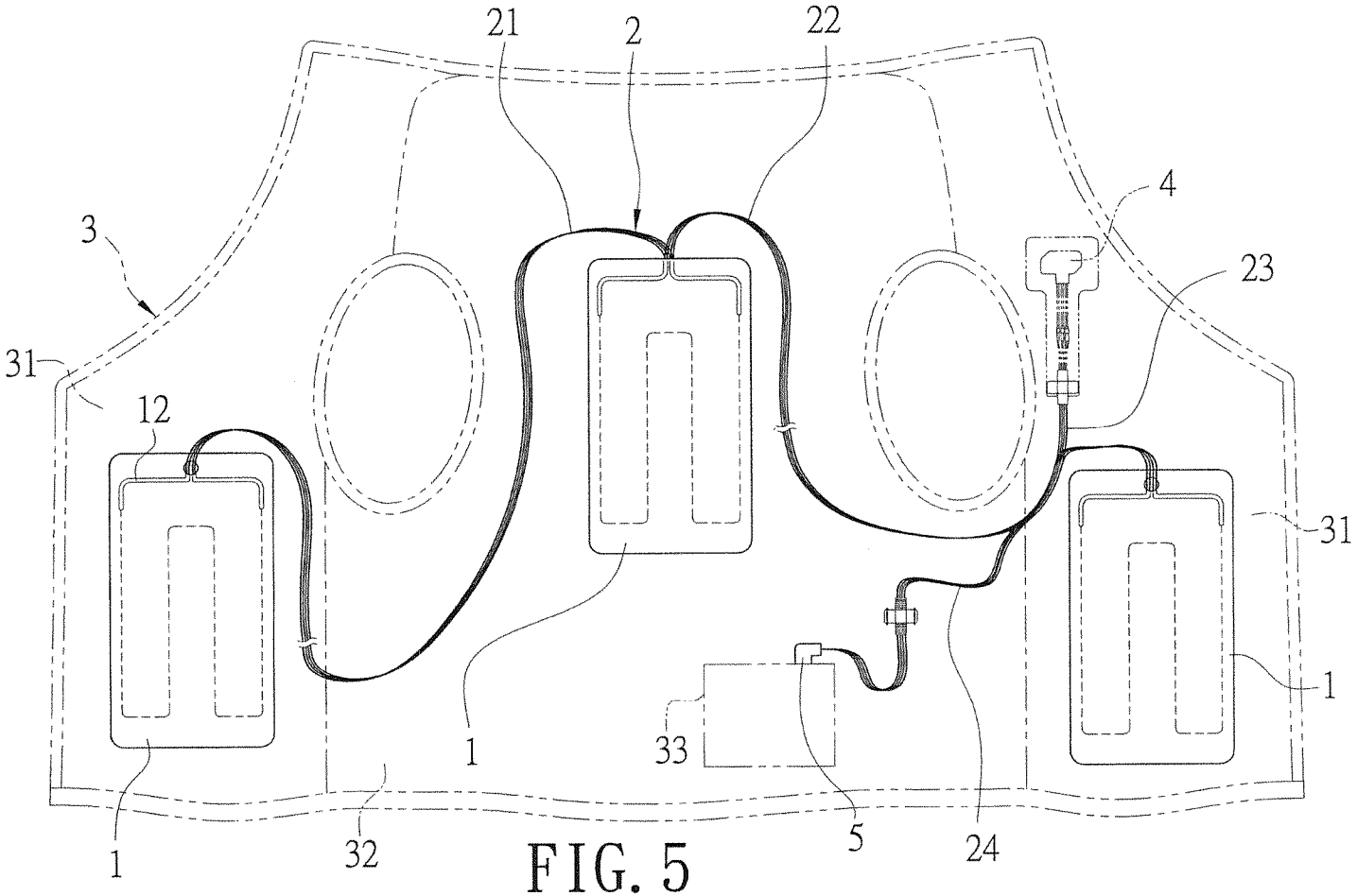
FIG. 5 is a front view of a connecting structure in a heated clothing according to another embodiment of the present invention.

Please refer to FIG. 4 and FIG. 5. The example that the heating plate 1 of the present invention is assembled to a heated clothing 3 and the assembly electric wire 2 is connected with the heating plate 1, a temperature control switch 4, and a battery plug 5 is described below. Two front parts 31 and a back part 32 between the two front parts 31 of the heated clothing 3 are set with a heating plate 1, respectively. The lengths of the electric wires out from the covering piece 14 of each heating plate 1 are equal. The temperature control switch 4 is set on the one of the front parts 31 of the heated clothing 3. A battery pocket 33 is set on the heated clothing 3, and the battery plug 5 is set at the battery pocket 33. Several assembly electric wires 2 are connected among the heating plates 1, the temperature control switch 4, and the battery plug 5 and connected to the electric wires 12 of the heating plates 1, the temperature control switch 4, and the battery plug 5, so that a conducting circuit is formed among the connection among the heating plates 1, the temperature control switch 4, and the battery plug 5. The lengths of the assembly electric wires 2 are relative to the distance among the heating plates 1, the temperature control switch 4, and the battery plug 5 on the different size of the heated clothing 3.

In detail, the connecting structure is described below. If the distance between the heating plate 1 at the left front part 31 of the heated clothing 3 and the heating plate 1 at the back part 32 is A, the length of a first assembly wire 21 is A for connecting the electric wires 12 of the heating plates 1 at the left front part 31 and the back part 32 of the heated clothing 3. If the distance between the heating plate 1 at the back part 32 of the heated clothing 3 and the heating plate 1 at the right front part 31 of the heated clothing 3 is B, the length of a second assembly wire 22 is B for connecting the electric wires 12 of the heating plates 1 at the right front part 31 and the back part 32 of the heated clothing 3. The temperature control switch 4 is set on the right front parts 31 of the heated clothing 3, and the distance between the temperature control switch 4 and the heating plate 1 at the right front part 31 of the heated clothing 3 is C, so that the length of a third assembly wire 23 is C for connecting the electric wires of the heating plate 1 at the right front part 31 of the heated clothing 3 and the temperature control switch 4. The distance between the temperature control switch 4 and the battery plug 5 set at the battery pocket 33 is D, so that the length of a fourth assembly wire 24 is D for connecting the electric wires of the temperature control switch 4 and the battery plug 5. According to the different distance among the heating plates 1, the temperature control switch 4, and the battery plug 5 in different size of the heated clothing 3, a proper length of the assembly wires 2 are used to connect them.

Therefore, it avoids assembled inconvenience which is caused by the excess length of the assembly wire 2 during the assembly process for the heated clothing 3 and avoids the assembly wire 2 in the lining of the heated clothing 3 twisting due to the excess length of the assembly wire 2. When the heated clothing 3 is washed in a washing machine, the twisted wire is broken easily under strong agitation and pull by the washing machine. Utilization of the bending structure of the first right angle 121, the horizontal segment 122, the second right angle 123, and the vertical segment 124 of the two electric wires 12 in the heating plate 1 of the present invention, the pulling strength is dispersed at the second right angle 123 when the vertical segment 124 of the electric wires 12 in the heating plate 1 is pulled, so that the pulling strength only acts on the vertical segment 124 and the second right angle 123. Even if a few of strength is transformed to the horizontal segment 122, the strength is dispersed again at the second right angle 123. Accordingly, it efficiently avoids the heater stripe 11 connected to the electric wire 12 moving under pulling. Furthermore, the heater strip 11 and the electric wires 12 are fixed by the fixed layers 13 with a high melting point, the fixed effects of the heater strip 11 is further increased to prevent the heater strip 11 from moving, even from being pulled out of the heating plate 1.

Figure 6:
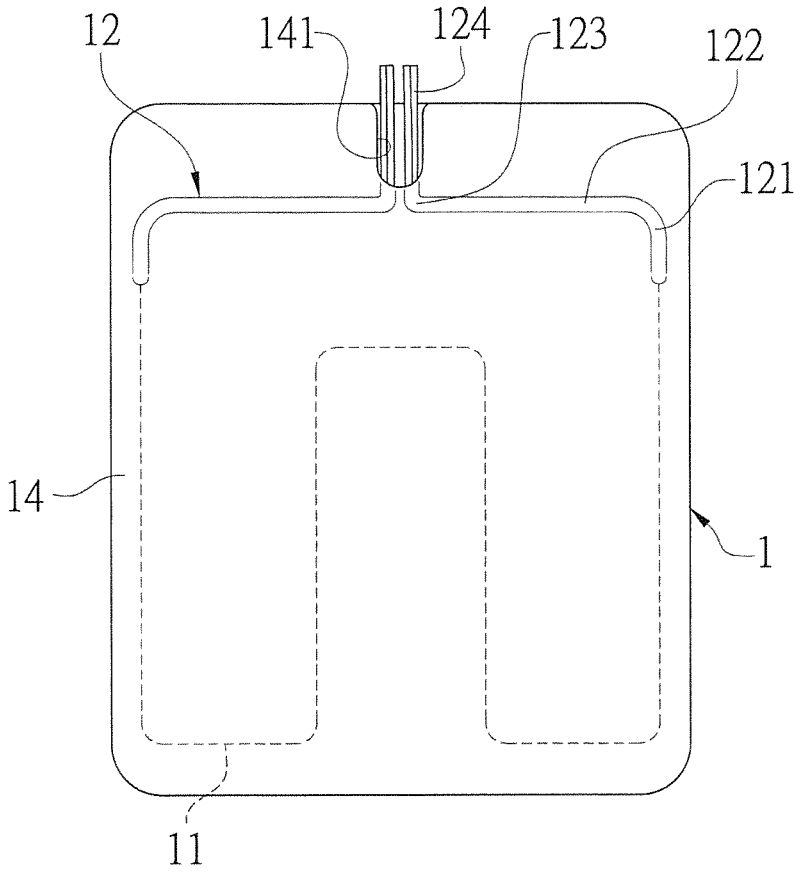
FIG. 6 is a front view of a heating plate according to another embodiment of the present invention.
Figure 7:
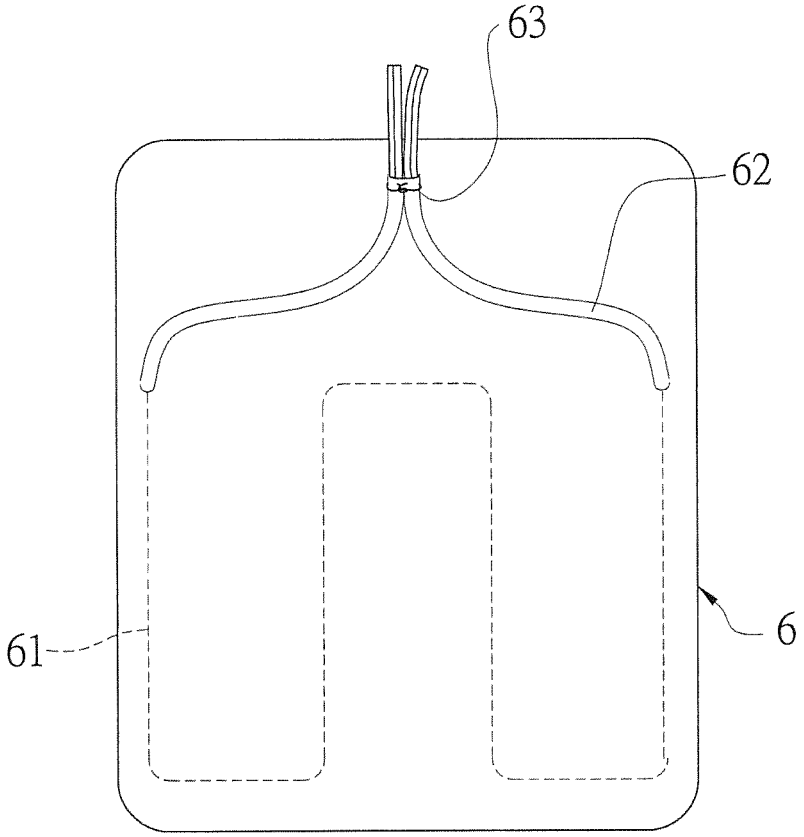
FIG. 7 (PRIOR ART)
FIG. 7 is a front view of a heating plate according to a prior art.

Please refer to FIG. 6, which is a front view of a heating plate for a heated clothing according to another embodiment of the present invention. The heating plate 1 is formed as membrane, and one of the fixed layers 13 is formed with an outlet 131 at the joint of the two electric wires 12 for the two electric wires 12 to go out from the outlet 131. And one of the covering pieces 14 is formed with an outlet 141, so that the two electric wires 12 out from the outlet 131 of the fixed layer 13 are out from the outlet 141 of the covering piece 14. The outlet 141 of the covering piece 14 is sewn to form an outlet for the convenience of the two electric wires 12 in the heating plate 1 to go out.

What is claimed is:

1. A heating pad for heated clothing, comprising:

two covering pieces, wherein the periphery of the two covering pieces is sealed together and one of the covering pieces is formed with an outlet;

a heater strip, held between the two covering pieces; and two electric wires of discrete structure connected to the two ends of the heater strip respectively and held between the two covering pieces, each electric wire extending continuously from an end of the heater strip to emerge from the covering pieces out through the outlet, each electric wire having an intermediate portion defining:

a first right angled bend;

a horizontal segment extending from the first right angled bend;

a second right angled bend extending from the horizontal segment; and a vertical segment extending from the second right angled bend;

wherein the first right angled bends of the two electric wires are disposed opposite to each other, and the vertical segments of the two electric wires converge and project out from the outlet.

2. The heating pad for the heated clothing according to claim 1, further comprising:

two fixed layers having a melting point higher than a thermal energy generated by the heater strip during use and formed as inner panels within the covering pieces, set about two sides of the heater strip and the electric wires between the covering pieces respectively, wherein one of the fixed layers is formed with an outlet for the vertical segments of the two wires to project out therethrough, and the two fixed layers are heat pressed to one another to hold the heater strip and the electric wires therebetween.

3. The heating pad for the heated clothing according to claim 2, wherein the outlets of the covering pieces and the fixed layers are each formed with one of a hole or slot configuration.

4. The heating pad for the heated clothing according to claim 1, wherein the outlet of the covering piece is formed with a hole or slot configuration.

5. A connecting structure in heated clothing, comprising:

an article of heated clothing;

at least two heating pads fitted on the article of heated clothing, and joined by a set of assembly electric wires extending therebetween, each of the first and second heating pads including:

two covering pieces, wherein the periphery of the two covering pieces is sealed together and one of the covering pieces is formed with an outlet;

a heater strip, held between the two covering pieces; and two electric wires of discrete structure connected to the two ends of the heater strip respectively and held between the two covering pieces, each electric wire extending continuously from an end of the heater strip to emerge from the covering pieces out through the outlet, each electric wire having an intermediate portion defining:

a first right angled bend;

a horizontal segment extending from the first right angled bend;

a second right angled bend extending from the horizontal segment; and a vertical segment extending from the second right angled bend;

wherein the first right angled bends of the two electric wires are disposed opposite to each other, and the vertical segments of the two electric wires converge and project out from the outlet;

wherein the lengths of the electric wires projecting out from the outlet of the covering piece are equal; and wherein the length of the set of assembly electric wires is selectively set relative to the distance along the article of heated clothing between the two heating pads to preserve uniform slack for different sizes of the article of heated clothing.

6. A connecting structure in heated clothing, comprising:

an article of heated clothing including two front parts and a back part connected to the two front parts;

a battery pocket disposed on the article of heated clothing;

a plurality of heating pads set on the two front parts and the back part of the heated clothing respectively, and joined by a plurality of assembly electric wires extending therebetween, each of the heating pads including:

two covering pieces, wherein the periphery of the two covering pieces is sealed together and one of the covering pieces is formed with an outlet;

a heater strip, held between the two covering pieces; and two electric wires of discrete structure connected to the two ends of the heater strip respectively and held between the two covering pieces, each electric wire extending continuously from an end of the heater strip to emerge from the covering pieces out through the outlet, each electric wire having an intermediate portion defining:

a first right angled bend;

a horizontal segment extending from the first right angled bend;

a second right angled bend extending from the horizontal segment; and a vertical segment extending from the second right angled bend;

wherein the first right angled bends of the two electric wires are disposed opposite to each other, and the vertical segments of the two electric wires converge and project out from the outlet; and the lengths of the electric wires projecting out from the covering piece of each heating pad are equal;

a temperature control switch set on the one of the front parts of the article of heated clothing; and a battery plug, set at the battery pocket of the article of heated clothing;

wherein the plurality of assembly electric wires interconnect the electric wires of the heating pads, the temperature control switch, and the battery plug, wherein the lengths of the assembly electric wires are selectively set relative to the distance along the article of heated clothing between the heating pads, the temperature control switch, and the battery plug to preserve uniform slack for different sizes of the article of heated clothing.

7. The connecting structure in heated clothing according to claim 6, wherein the assembly electric wires includes:

a first assembly electric wire, wherein the length of the first assembly electric wire is selectively set relative to the distance between the heating pad set on the one of the front parts of the article of heated clothing and the heating pad set on the back part of the article of heated clothing;

a second assembly electric wire, wherein the length of the second assembly electric wire is selectively set relative to the distance between the heating pad set on the back part of the article of heated clothing and the heating pad set on the other of the front parts of the article of heated clothing;

a third assembly electric wire, wherein the length of the third assembly electric wire is selectively set relative to the distance between the temperature control switch on one of the front parts and the heating pad set on the same front part of the article of heated clothing; and a fourth assembly electric wire, wherein the length of the fourth assembly electric wire is selectively set relative to the distance between the temperature control switch and the battery plug.

* * * * *